US006328603B1

(12) United States Patent
Chang

(10) Patent No.: US 6,328,603 B1
(45) Date of Patent: Dec. 11, 2001

(54) ELECTRIC CONNECTOR GROUNDING STRUCTURE

(75) Inventor: Chih-Kai Chang, Sanchung (TW)

(73) Assignee: Speed Tech Corp., Taoyuan Hsien (TW)

( * ) Notice: Subject to any disclaimer, the term of this patent is extended or adjusted under 35 U.S.C. 154(b) by 2 days.

(21) Appl. No.: 09/818,678

(22) Filed: Mar. 28, 2001

(51) Int. Cl.[7] ..... H01R 33/945

(52) U.S. Cl. ..... 439/620; 439/609; 439/96; 174/51

(58) Field of Search ..... 439/95, 96, 490, 439/567, 76.1, 607, 609, 620, 676, 701; 361/816, 821; 174/51, 52.1

(56) References Cited

U.S. PATENT DOCUMENTS

| | | | | |
|---|---|---|---|---|
| 4,668,873 | * | 5/1987 | Ohba et al. | 307/9 |
| 5,189,638 | * | 2/1993 | Kimura | 365/52 |
| 6,188,014 | * | 2/2001 | Baur | 174/51 |
| 6,227,911 | * | 5/2001 | Boutros et al. | 439/620 |

* cited by examiner

*Primary Examiner*—Khiem Nguyen
(74) *Attorney, Agent, or Firm*—Bacon & Thomas, PLLC

(57) ABSTRACT

An electric connector grounding structure includes an electrically insulative housing, the electrically insulative housing comprising a receiving chamber adapted to receive a matching electric connector; an electric circuit assembly unit mounted in the electrically insulative housing, the electric circuit assembly unit including a terminal holder holding a set of terminals in the receiving chamber for the connection of the respective terminals of the matching electric connector, a circuit board supported on the terminal holder and soldered to the terminals in the terminal holder, the circuit board having a plurality of terminals respectively inserted through respective terminal slots of the terminal holder for connection to an external circuit board, and an electronic component part unit, the electronic component part unit having a grounding terminal extended out of the electrically insulative housing, a metal shield covered on the electrically insulative housing to hold down the grounding terminal of the electronic component part unit and to form with the grounding terminal of the electronic component part unit a grounding loop.

8 Claims, 7 Drawing Sheets

ELECTRIC CONNECTOR GROUNDING STRUCTURE

BACKGROUND OF THE INVENTION

The present invention relates to electric connectors, and more specifically, to an electric connector grounding structure in which the grounding terminal of the capacitor of the electronic component part unit of the circuit board is positioned in a locating groove at the top side of the electrically insulative housing and held down by the metal shield to form with the metal shield a grounding loop.

Following fast development of computer technology, advanced desktop and notebook computers have been continuously developing. In consequence, a variety of electric connectors have been disclosed for use with computers. During signal transmission through a computer connector, external electromagnetic interference and internal static interference must be eliminated. In order to eliminate these interferences, regular computer connectors are commonly equipped with a metal shield (metal grounding shell). FIGS. 5 and 6 show a prior art design. According to this design, the terminal holder is directly soldered to the circuit board. This design effectively eliminates the interference of external electromagnetic waves. However, this design cannot eliminate internal static interference. There are known another two measures to eliminate the problem of external electromagnetic interference and internal static interference. One measure is to directly solder a grounding wire to the grounding terminal of the circuit board of the electric connector and the metal shield covering the electric connector. This measure complicates the fabrication procedure of the electric connector, and also greatly increases the manufacturing cost of the electric connector. The other measure is the use of an electrically conductive cloth to connect the grounding contact of the circuit board of the electric connector to the metal shield. This measure also complicates the fabrication procedure of the electric connector and increases the manufacturing cost of the electric connector.

SUMMARY OF THE INVENTION

The present invention has been accomplished to provide an electric connector grounding structure, which eliminates the aforesaid drawbacks. It is the main object of the present invention to provide an electric connector grounding structure, which automatically forces the grounding terminal of the electronic component part unit of the circuit board into contact with the metal shield after installation of the metal shield in the electrically insulative housing of the electric connector to form a grounding loop. According to the present invention, the capacitor of the electronic component part unit circuit board of the electric connector has a grounding terminal positioned in a locating groove at the top sidewall of the electrically insulative housing, an the metal shield has a protruded portion, which is pressed on the grounding terminal after installation of the metal shield in the electrically insulative housing. Therefore, the metal shield forms with the grounding terminal of the circuit board a grounding loop when installed in the electrically insulative housing.

DETAILED DESCRIPTION OF THE PREFERRED EMBODIMENT

Figure 1:
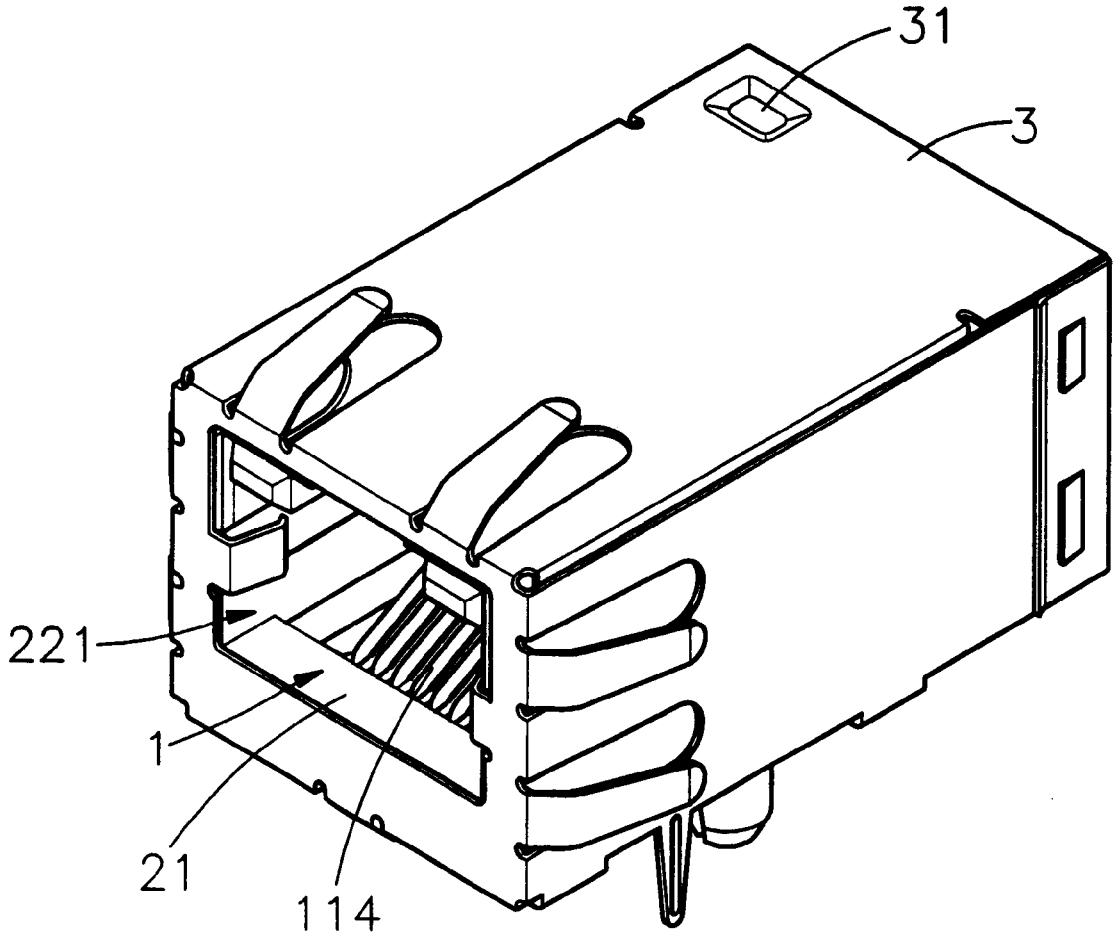
FIG. 1 is a perspective view of the preferred embodiment of the present invention.
Figure 2:
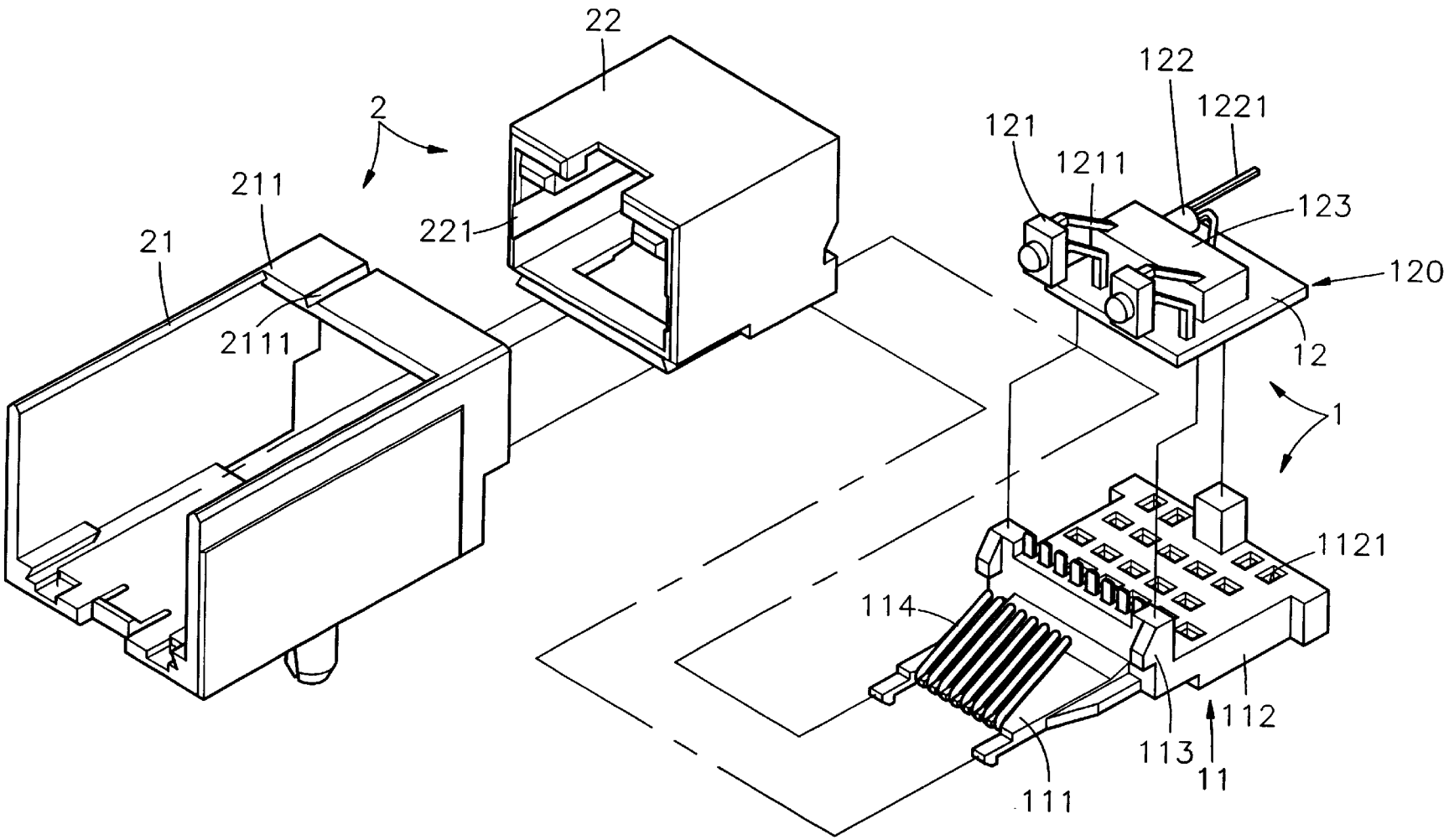
FIG. 2 is an exploded view of the preferred embodiment of the present invention (the metal shield excluded).
Figure 3:
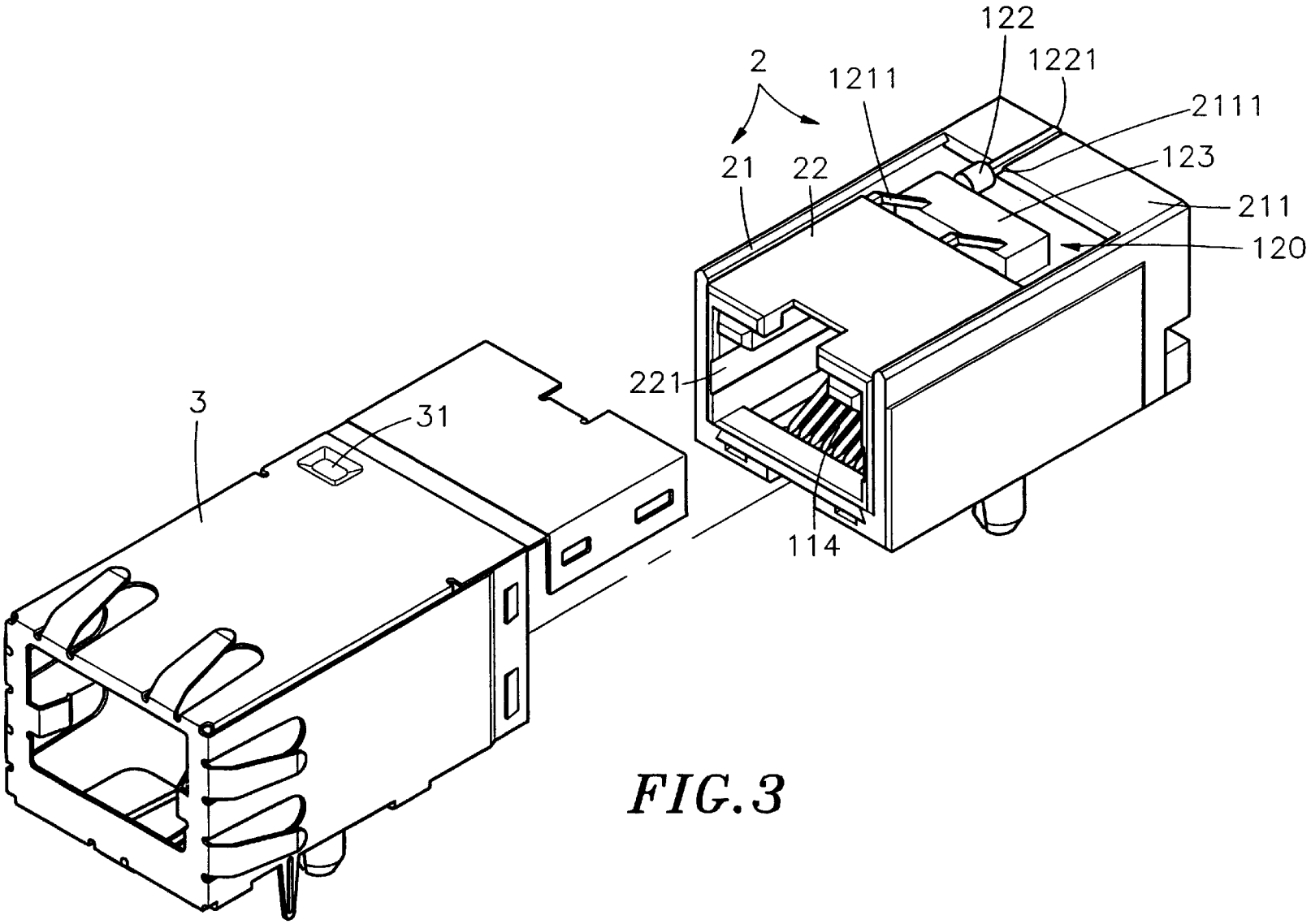
FIG. 3 is an exploded view of the present invention, showing the electric circuit assembly unit installed in the electrically insulative housing.

Referring to FIGS. from 1 through 3, the present invention comprises an electric circuit assembly unit 1, an electrically insulative housing 2, and a metal shield 3.

The electric circuit assembly unit 1 is comprised of a terminal holder 11 and a circuit board 12. The terminal holder 11 is a flat rectangular member comprising a base 113, a front extension board 111 forwardly extended from the base 113, a rear extension board 112 backwardly extended from the base 113, and a plurality of terminals 114 mounted in the front extension board 111 and the base 113 and arranged in parallel. The rear extension board 112 has a plurality of terminal slots 1121. The terminals 114 each have a front end protruded from the front side of the front extension board 111 and turned backwardly upwards, and a rear end backwardly extended out of the base 113 and soldered to the circuit board 12. The circuit board 12 comprises an electronic component part unit 120 and a plurality of terminals 1122. The electronic component part unit 120 includes light emitting diodes 121, a capacitor 122, and a filter module 123. The terminals 1122 are respectively inserted through the terminal slots 1121 of the rear extension board 112 of the terminal holder 11 for connection to respective contacts of an external circuit board (not shown). The capacitor 122 has a grounding terminal 1221 for connection to the metal shield 3. The electrically insulative housing 2 comprises an outer casing 21 and an inner casing 22. The outer casing 21 comprises a locating groove 2111 disposed at the top surface of the top sidewall 211 thereof. The inner casing 22 fits into the outer casing 21, comprising a receiving chamber 221 adapted to receive a matching electric connector. After insertion of the inner casing 22 into the rear end of the outer casing 21, a gap is defined between the bottom sidewall of the outer casing 21 and the bottom sidewall of the inner casing 22 for receiving the front extension board 111 of the terminal holder 11 of the electric circuit assembly unit 1. The metal shield 3 is covered on the electrically insulative housing 2, comprising a top recess 31.

Figure 4:
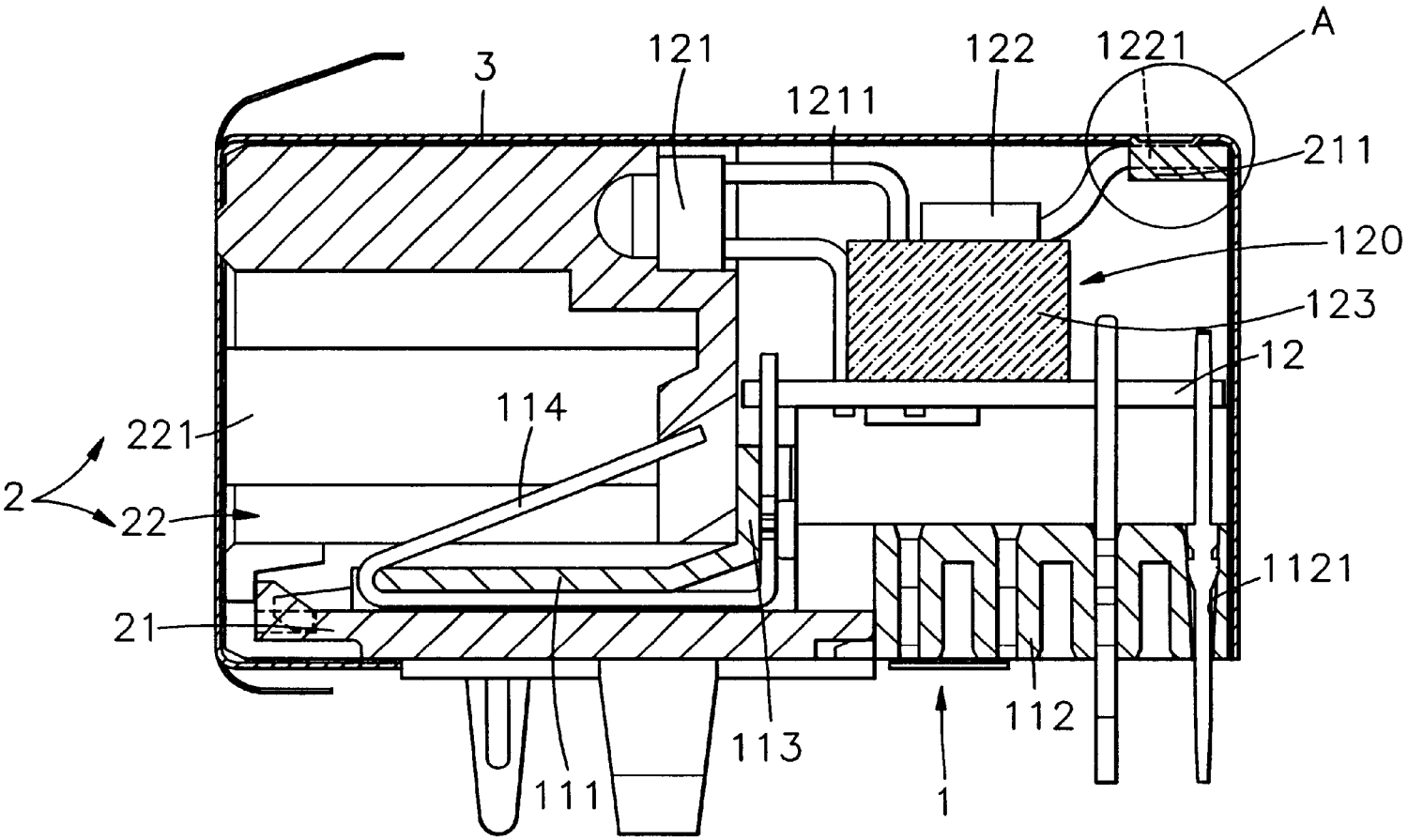
FIG. 4 is a side view in section of the present invention.
Figure 4A:
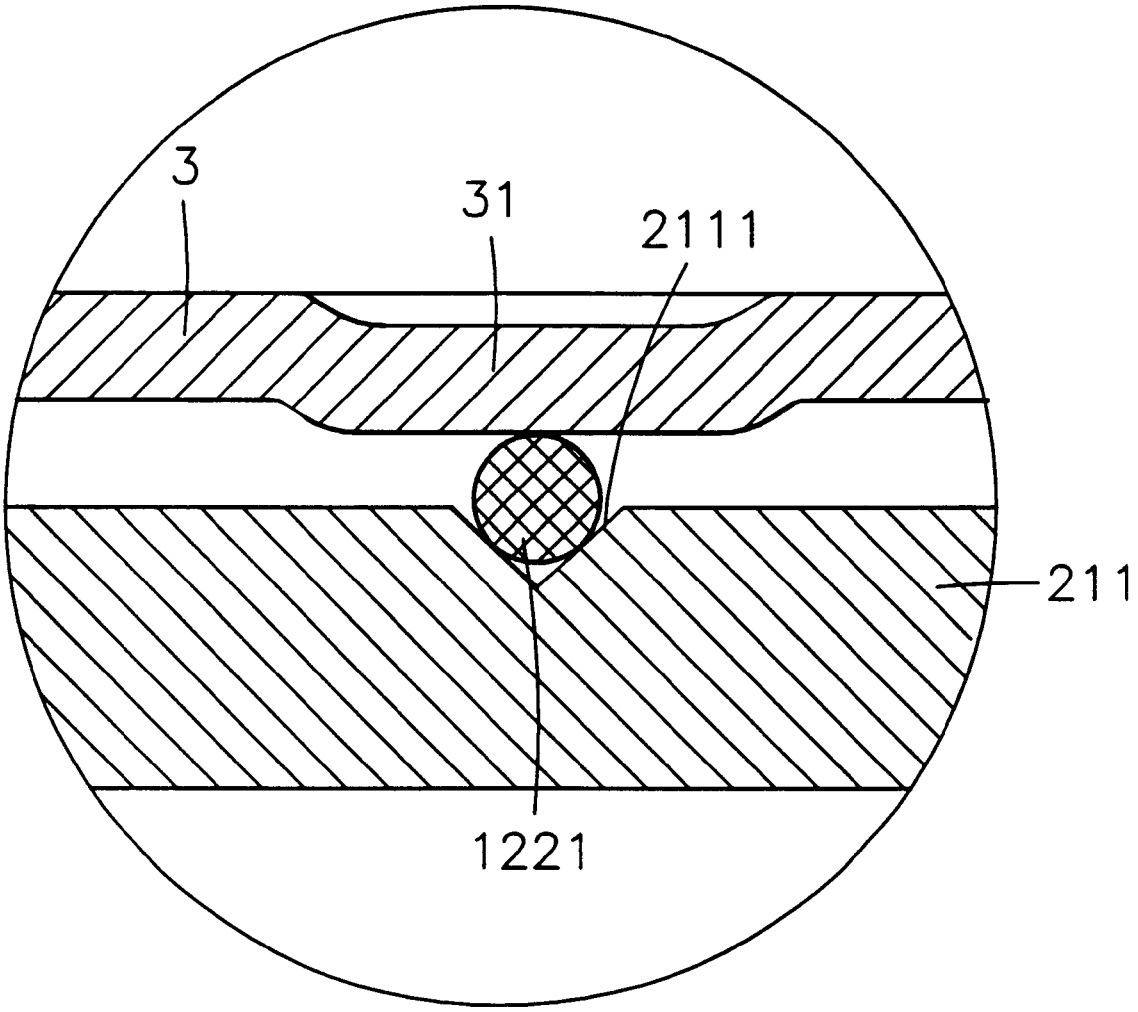
FIG. 4A is an enlarged view of a part of the present invention, showing the grounding terminal of the capacitor positioned in the locating groove of the outer casing, the protruded portion of the metal shield pressed on the grounding terminal of the capacitor.
Figure 5:
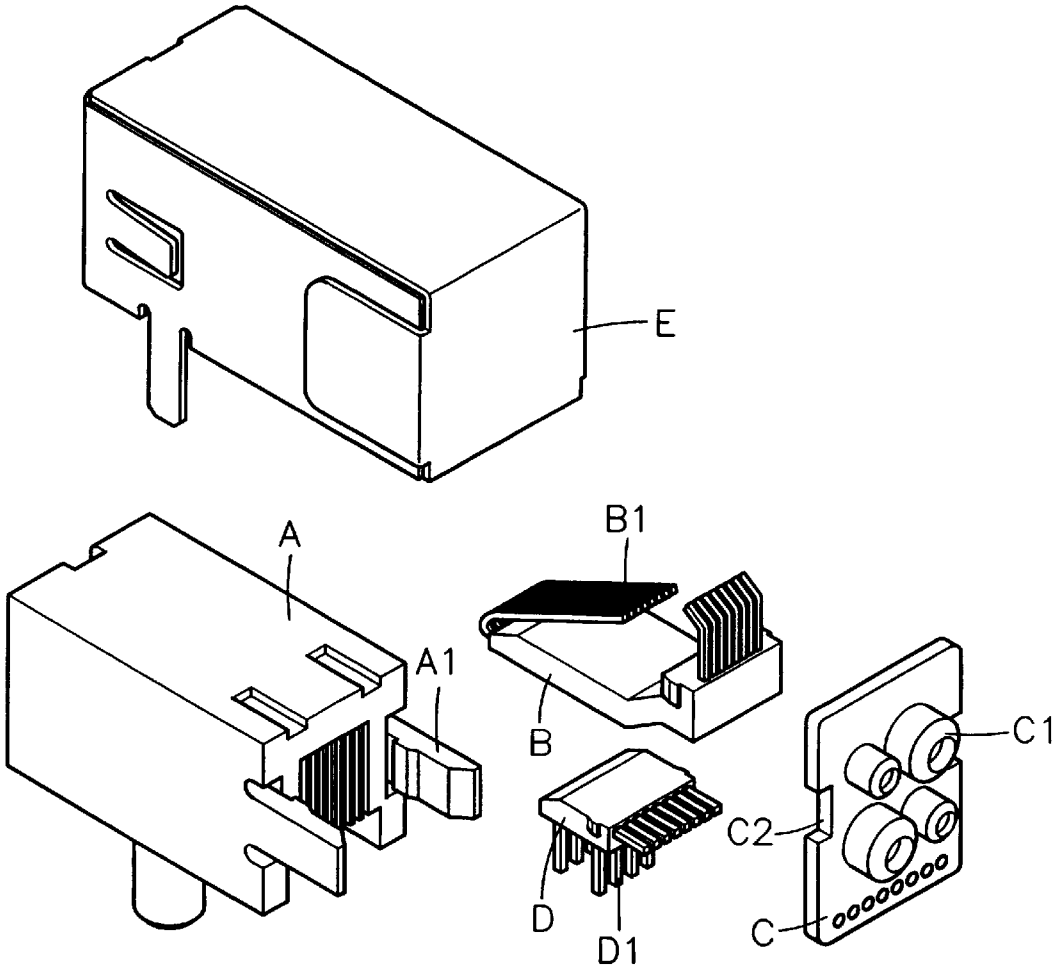
PRIOR ART FIG. 5
FIG. 5 is an exploded view of the prior art design.
Figure 6:
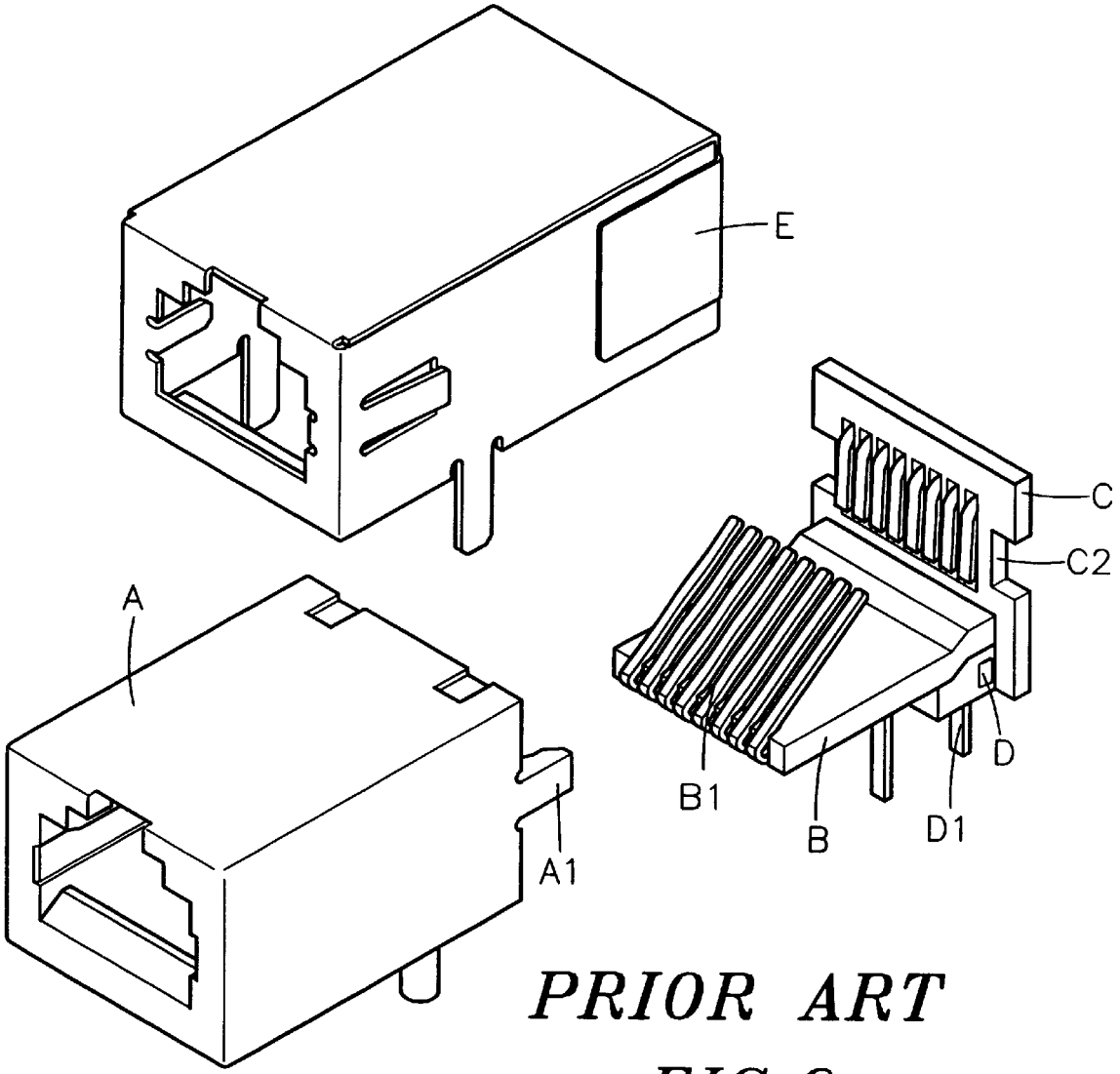
PRIOR ART FIG. 6
FIG. 6 is another exploded view of the prior art design showing the terminal holders and the circuit board assembled.

The assembly process of the present invention is outlined hereinafter with reference to FIGS. 4 and 4A and FIGS. 2 and 3 again. The light emitting diodes 121, the capacitor 122, and the filter module 123 are soldered to the respective contacts at the top side of the circuit board 12, and then the terminals 1122 are respectively soldered to the respective contacts (not shown) at the bottom side of circuit board 12 at the bottom side, and then the terminals 1122 are respectively inserted through the terminal slots 1121 of the rear extension board 112 of the terminal holder 11 and soldered to the respective contacts of the external circuit board (not shown) for enabling the circuit board 12 to be supported on the rear extension board 112, and then the tail of each of terminals 114 of the terminal holder 11 is respectively soldered to the circuit board 12 see FIG. 4), and then the inner casing 22 is inserted into the outer casing 21 from the rear side of the outer casing 21, and then the front extension board 111 is inserted into the gap between the bottom sidewall of the inner casing 22 and the bottom sidewall of the outer casing 21, and then the grounding terminal 1221 of the capacitor 122 is put in the locating groove 2111 of the outer casing 21, and then the metal shield 3 is covered on the electrically insulative housing 2, keeping a protruded portion 31 of the metal shield 3 pressed on the grounding terminal 1221 of the capacitor 122 (see FIGS. 4 and 4A). When assembled, the terminals 114 of the terminal holder 11 are suspended in the receiving chamber 221 of the inner casing 22 of the electrically insulative housing 2 for the contact of the respective terminals of the matching electric connector (not shown).

As indicated above, the electronic component part unit 120 comprises two light emitting diodes 121. The lead-out wires 1211 of the light emitting diodes 121 are respectively connected to the circuit board 12. During signal transmission through the electric connector, the light emitting diodes 121 are turned on to emit light toward the front side of the electric connector, indicating the operation status of the electric connector.

Instead of connecting the grounding terminal 1221 of the capacitor 122 to the metal shield 3, the grounding terminal of either electronic component part of the electronic component part unit 120 can be connected to the metal shield 3 to form with the metal shield 3 a grounding loop.

As indicated above, the present invention achieves the following advantages.

(1) After installation of the metal shield in the electrically insulative housing, the metal shield and the grounding terminal of the capacitor of the electronic component part unit automatically form a grounding loop to eliminate noises, and therefore the invention greatly reduces the grounding cost of the electric connector.

(2) Because the grounding terminal of the capacitor of the electronic component part unit is positioned in the locating groove of the electrically insulative housing and the protruded portion of the metal shield is pressed on the grounding terminal of the capacitor, the connection between the grounding terminal of the capacitor and the metal shield is assured.

(3) Because the invention uses a regular capacitor to form with the metal shield a grounding loop, the manufacturing cost of the electric connector is greatly lower than that using a SMT (surface mounting technique) capacitor.

(4) Because all parts of the electronic component part unit are gathered on the circuit board, the assembly process of the electric connector is simple.

A prototype of electric connector grounding structure has been constructed with the features of FIGS. 1~4. The electric connector grounding structure functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric connector grounding structure comprising:

an electrically insulative housing, said electrically insulative housing comprising a receiving chamber adapted to receive a matching electric connector;

an electric circuit assembly unit mounted in said electrically insulative housing, said electric circuit assembly unit comprising a terminal holder mounted in said electrically insulative housing, and a circuit board supported on said terminal holder, said terminal holder comprising a base, a front extension board and a rear extension board respectively extended from front and rear sides of said base in reversed directions, said rear extension board comprising a plurality of terminal slots, and a plurality of terminals respectively mounted in the front extension board and base of said terminal holder, said circuit board comprising a plurality of terminals respectively inserted through the terminal slots of said terminal holder for connection to an external circuit board, and an electronic component part unit, said electronic component part unit having a grounding terminal extended out of a top sidewall of said electrically insulative housing; and a metal shield covered on said electrically insulative housing to hold down said grounding terminal of said electronic component part unit and to form with said grounding terminal of said electronic component part unit a grounding loop.

2. The electric connector grounding structure of claim 1 wherein said electrically insulative housing is comprised of an outer casing and an inner casing mounted in said outer casing and defining said receiving chamber.

3. The electric connector grounding structure of claim 1 wherein said electronic component part unit includes a capacitor.

4. The electric connector grounding structure of claim 1 wherein said electronic component part unit includes a filter module.

5. The electric connector grounding structure of claim 1 wherein said electronic component part unit includes at least one light emitting diode adapted to emit light toward a front side of said electrically insulative housing.

6. The electric connector grounding structure of claim 1 wherein the terminals of said terminal holder each having a tail respectively soldered to said circuit board and a front end extended out of a front side of said front extension board and turned backwardly upwards and suspending in said receiving chamber of said electrically insulative housing.

7. The electric connector grounding structure of claim 1 wherein said electrically insulative housing comprises a locating groove disposed outside a top sidewall thereof, which receives the grounding terminal of said electronic component part unit, keeping the grounding terminal of said electronic component part unit in contact with said metal shield.

8. The electric connector grounding structure of claim 7 wherein said metal shield comprises a protruded portion pressed on the grounding terminal of said electronic component part unit in the locating groove of said electronically insulative housing.

* * * * *